US006776648B1

(12) United States Patent
Hernando

(10) Patent No.: US 6,776,648 B1
(45) Date of Patent: Aug. 17, 2004

(54) ELECTRICAL PLUG INSTALLER AND REMOVER

(76) Inventor: David Hernando, 1211 Fosters Mill La., Boynton Beach, FL (US) 33436

( * ) Notice: Subject to any disclaimer, the term of this patent is extended or adjusted under 35 U.S.C. 154(b) by 0 days.

(21) Appl. No.: 10/664,632

(22) Filed: Sep. 18, 2003

(51) Int. Cl.[7] ..... H01R 13/00

(52) U.S. Cl. ..... 439/476.1; 439/478; 294/19.1; 294/104

(58) Field of Search ..... 439/476.1, 477–478; 294/19.1, 104, 97

(56) References Cited

U.S. PATENT DOCUMENTS 2,517,275 A * 8/1950 Bartrug ..... 294/104

2,742,806 A * 4/1956 Pavelka ..... 81/53.1

* cited by examiner

*Primary Examiner*—Truc Nguyen

(74) *Attorney, Agent, or Firm*—Donald W. Meeker

(57) ABSTRACT

An electric plug remover and installer with a long adjustable lever arm that has adjustable pivot arms for bearing against a wall or piece of furniture hiding an electric wall outlet and a bottom clamp for holding electric plugs, which is operated by a top hand grip. Elongated clamp arms with enlarged gripping heads are attachable for larger plugs such as those with transformers.

7 Claims, 3 Drawing Sheets

ELECTRICAL PLUG INSTALLER AND REMOVER

BACKGROUND OF THE INVENTION

1. Field of the Invention

The present invention relates to electrical plug removal and installation devices and in particular to an electric plug remover and installer having a long adjustable lever arm with adjustable pivot arms for bearing against a wall or piece of furniture hiding an electric wall outlet for a mechanical advantage enabling easy removal and installation of electric plugs held in a bottom clamp operated by a top hand grip.

2. Description of the Prior Art

Electrical outlets are frequently crowded environments in which it can be dangerous or difficult to handle components with the fingers. It is desirable to have tools which are small or portable, easily operable and manipulated by one hand, and which can grasp electrical plugs firmly, capturing them so that they can be manipulated in any orientation for installing or removing the plugs from electrical outlets.

Prior art U.S. Pat. No. 5,516,305, issued May 14, 1996 to Haluska, provides an electrical plug removal device for use with electrical plugs of the type that have an electrical cord and electrically conductive spaced apart blades or prongs, with the electrically conductive spaced apart blades to be plugged into an electrical outlet or receptacle. The electrical plug removal device is constructed from thin non-conductive semi-flexible material designed to be used with a variety of electrical plugs having different types of cord caps and different shapes, configurations and numbers of electrically conductive spaced apart blades or prongs. Electrical plug blade receiving means formed in a central portion of an elongated main body accept the electrically conductive blades of the electrical plug. Other portions of the elongated main body are folded over the electrical plug and are removably joined thereby encompassing the electrical plug and the electrical cord. The end of the electrical plug removal device also has continuously formed thereon a gripping means. A users can easily and safely grasp the gripping means of the electrical plug removal device to effect the safe removal of an electrical plug from electrical outlets or receptacles without causing damage to the electrical cord or to the electrical plug.

Prior art U.S. Pat. No. 4,253,697, issued Mar. 3, 1981 to Acosta, shows a retrieving instrument featuring a snap-lock handle connected to one end of a flexible cable, the other end of which has a releasible gripping head. The gripping head may be mechanically or electromagnetically operated, there is an actuation control mechanism that locks the jaw in either the gripping mode or the release mode until the control is changed. A viewing system utilizing newly developed fiber optic techniques is preferably incorporated into the structure.

Prior art U.S. Pat. No. 5,687,889, issued Nov. 18, 1997 to Liden, claims a manually operable combination device to help a user who cannot bend at the back, waist, or knees with applying socks, shoes, pants, tightening and loosening shoe laces, removing socks and picking things up off the ground. The device includes components to provide a reacher function with a pivoting closeable jaw operated by a trigger mechanism, a flexible or rigid plastic shovel, and a longitudinally sliding hook operated by a lever. The plastic shovel is used to apply socks and as a shoehorn. The reacher is used to apply shoes and remove socks and to pick articles up from floor. A sliding hook is used in conjunction with cord clamps on shoelaces to tighten laces. The hook is also used for application of pants.

Prior art U.S. Pat. No. 5,577,785, issued Nov. 26, 1996 to Traber, describes a single-hand actuated pick-up tool. The tool includes an elongated hollow stalk terminating at spaced-apart distal and proximal ends. The tool also includes first and second short, flexible, spring pick-up fingers extending divergently outward from the distal end of the stalk and includes flexible elements terminating the outer ends of the fingers for grasping an object when brought toward one another. The tool also comprises a center strap extending from the first pick-up finger interiorly along the stalk and then back interiorly to the second pick-up finger. The tool has a handle formed in cooperation with the stalk that includes a handle member pivotally mounted to the stalk and further including a device for drawing the center strap rearward the fingers when the handle member is pivoted toward the stalk. The tool also comprises a first hollow stalk plug for slidable insertion in the distal end of the stalk for retaining the fingers by friction in mounted position in the stalk.

Prior art U.S. Pat. No. 4,962,957, issued Oct. 16, 1990 to Traber, discloses a single hand-actuated pick-up tool of the type that comprises an elongated shaft terminating at spaced-apart upper and lower ends. The device also comprises a pair of spaced-apart, pick-up fingers that extend from the lower end of the shaft that include a pair of springs for biasing them apart. The tool also includes a pair of ribbons that include a handle with a finger-actuable trigger at the upper end, biased apart from the handle, for drawing the fingers together as the trigger is squeezed against the handle. The improvement provides for the fingers to be able to close together and form locked configurations less than the fully-opened configuration including an arm extending from the trigger for reciprocal motion as a function of movement of the trigger, at least one notch formed in the arm adapted for engagement with a stop in the handle. The tool also includes a spring urging the arm into sliding contact with the stop as the trigger is moved. The tool also comprises and a lever pivotally mounted at the upper shaft end for movement between a first unlocked position that permits the spring to retain the arm in contact with the stop and a second, unlock position where the arms moved out of contact with the stop to permit full range of motion of the fingers from full open to full closed.

Prior art U.S. Pat. No. 4,758,035, issued Jul. 19, 1988 to Shimasaki, a gripping and reaching device for persons with wrist or grip disabilities comprising a one-piece forearm brace which pivotally mounts an axially aligned extension arm having a pair of opposed object engaging gripping elements at its end. The gripper elements are brought into initial contact with the object located therebetween by hand operation of a trigger mounted to the brace. Upon lifting of the object, the gripping elements are further tightened about the object by a cable linkage, which is tensioned in response to pivotal movement of the extension arm with a force corresponding to the weight of the object.

Prior art U.S. Pat. No. 3,937,512, issued Feb. 10, 1976 to Baughman, puts forth a lightweight grab stick, which incorporates a hand-grip with trigger pull action. The support column and swing leg are of channel form and the trigger rod is connected to a control link member. The tips of the support column and swing leg are flattened to provide gripper jaws. The control link member is pivoted at triangularly spaced points respectively to the support column, the trigger rod and a pull rod that is connected to the swing leg. The control link and swing leg are on opposite sides of the support column and the pull rod protects through the support column. A guide prevents lateral motion of the swing leg.

Prior art U.S. Pat. No. 6,520,556, issued Feb. 18, 2003 to Hsu, concerns a gripping device that includes a hand-grip rotatably secured to a handle with a shaft. The device also comprises a base secured to the handle, a pair of gripping fingers rotatably secured to the base and coupled to the hand-grip which may actuate the gripping fingers to grasp an object. A device may lock the hand-grip to the handle with a pivotal pawl. A button may selectively lock the pawl to the hand-grip. A tube and a pipe are adjustably secured between the handle and the gripping fingers. A cable is secured to the hand-grip, and a beam is selectively secured to the cable with teeth engagement.

Prior art U.S. Pat. No. 6,513,844, issued Feb. 4, 2003 to Hsu, illustrates a gripping device that includes a hand-grip rotatably secured to a handle with a shaft. The device also comprises a base secured to the handle, a pair of gripping fingers rotatably secured to the base and coupled to the hand-grip which may actuate the gripping fingers to grasp an object. A device may lock the hand-grip to the handle with a pivotal pawl. A button may selectively lock the pawl to the hand-grip. A tube and a pipe are adjustably secured between the handle and the gripping fingers. A cable is secured to the hand-grip, and a beam is selectively secured to the cable with teeth engagement.

Prior art U.S. Pat. No. 4,231,603, issued Nov. 4, 1980 to Van Zelm, is for an improved gripping device for use by handicapped persons. The gripping device consists of double acting jaws that grip the item to be picked up or lifted. The gripping device also comprises a forward arm section, a rearward arm section, and a control mechanism to control the gripping action of the double acting jaws and the hinge action between the forward arm section and the rearward arm section. The device can be operated with one hand. It can also be operated from a wheel chair.

Prior art U.S. Pat. No. 4,374,600, issued Feb. 22, 1983 to Van Zelm, provides an improved lock for a gripping device, for use by handicapped persons, with a lock-type member to improve safety. The gripping device consists of double acting jaws that grip the item to be picked up or lifted. The gripping device also comprises a forward arm section, a rearward arm section, and a control mechanism to control the gripping action of the double acting jaws and the hinge action between the forward arm section and the rearward arm section. A lock-type safety member for the hinge action improves the safety factor when using the device. The device with the lock-type safety member can be operated with one hand and can be operated from a wheel chair.

Prior art U.S. Pat. No. 2,869,914, issued Jan. 20, 1959 to Yoakley, Jr., shows an extension arm for grasping article that would otherwise be out of reach. The extension arm has spring biased construction so that its tongs are normally spring biased to an open position. The tongs are closed by pulled on an actuating lever at the opposing end of the extension arm.

What is needed is a remote device that can grasp electrical plugs firmly, capturing them so that they can be manipulated in any orientation for installing or removing the plugs from electrical outlets.

SUMMARY OF THE INVENTION

An object of the present invention is to provide a remote device that can grasp electrical plugs firmly, capturing them so that they can be manipulated in any orientation for installing or removing the plugs from electrical outlets.

Another object of the present invention is to provide an electrical plug inserter and remover that is simple, easily operable by one hand, and is able to capture and retain the electrical plug being handled until the operator chooses to disconnect the tool from the plug.

One more object of the present invention is to provide an electrical plug inserter and remover with a long lever arm, which has pivot arms for bearing against a wall or piece of furniture hiding an electric wall outlet for a mechanical advantage enabling easy removal and installation of electric plugs.

An additional object of the present invention is to provide an electrical plug inserter and remover with a lever arm and pivot arms that are formed of at least two telescoping components and are adjustable in length.

Yet one more object of the present invention is to provide add-on elongated clamp arms with enlarged grips to be attached to the plug clamp to enable gripping larger plugs such as those housing transformers.

A further object of the present invention is to provide a periscope that may be attached along the length of the elongated lever arm, so that a user may look into the top opening of the periscope and see a wall outlet adjacent to the bottom opening of the periscope.

In brief, a remote electric plug installer and remover device for installing and removing an electric plug in an electric wall outlet located on a portion of a wall behind an obstruction. The device comprises a rigid elongated lever arm that has a bottom clamp attached to the bottom end of the lever arm. The lever arm is formed of two telescoping components and is adjustable in length. The bottom clamp comprises a pair of jaws that are pivotally attached together. The bottom clamp grips and releases an electric plug to install and remove the electric plug from the electric wall outlet. The device further comprises a top hand grip attached to the top end of the lever arm. The hand grip has a pair of pivotally connected handles and a cable for communicating with the bottom clamp, thereby opening and closing the bottom clamp.

The device also comprises a pair of pivot arms that are movably attached to the lever arm and are positioned between the top end and the bottom end of the lever arm. The pair of pivot arms extend outwardly from the lever arm on opposing sides of the lever arm. The pivot arms are of two different lengths and each comprise two telescoping components, making them adjustable in length. One of the pair of pivot arms bears against the wall to enable the removal of the electric plug from the wall outlet by moving the top end of the lever arm toward the wall, thereby pivoting the bottom end of the lever arm away from the wall with the electric plug in the bottom clamp and removing the electric plug from the wall outlet. The other of the pair of pivot arms bears against the obstruction to enable the installation of the electric plug in the wall outlet by moving the top end of the lever arm away from the wall, thereby pivoting the bottom end of the lever arm toward the wall with the electric plug in the bottom clamp, thereby installing the electric plug in the wall outlet.

The device may also comprise a periscope that is attachable to the elongated lever arm along the length of the lever arm. The periscope comprises an elongated hollow tube that has a pair of angled mirrors, which communicate between the top viewing opening and the bottom opening so that a user may look into the top opening and see a wall outlet adjacent to the bottom opening.

Add-on elongated clamp arms with enlarged grips may be attached to the plug lamp to enable gripping larger plugs such as those housing transformers.

An advantage of the present invention is that it allows for remote installation and removal of an electrical plug from a wall outlet without having to move obstructions, such as furniture.

Another advantage of the present invention is that it is adjustable in length.

An additional advantage of the present invention is that allows for remote viewing the electrical plug.

One more advantage of the present invention is it is simple to operate.

Yet another advantage of the present invention is inexpensive to manufacture.

Still another advantage of the present invention is that it is small and portable.

Yet another advantage of the present invention is that it works with a variety of plug sizes.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
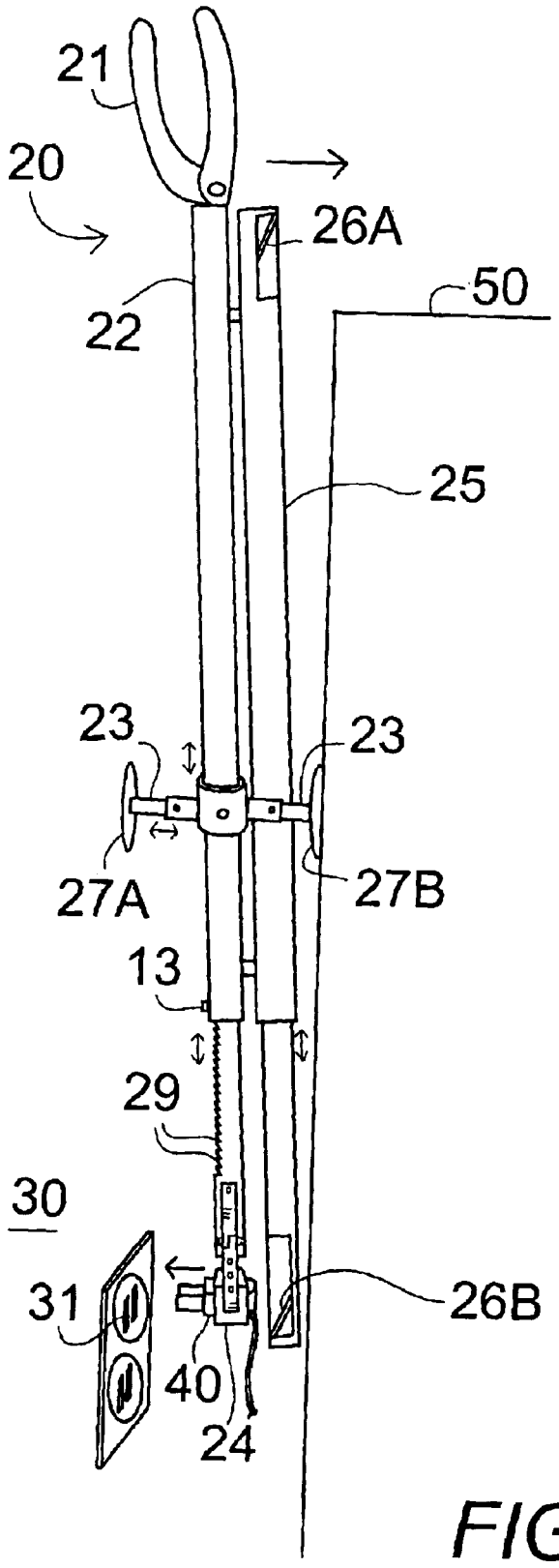
FIG. 1 is an elevational view of the electric plug remover and installer device of the present invention installing an electric plug in an electric wall outlet behind a piece of furniture using the pivot arm of the device against the piece of furniture for leverage.
Figure 2:
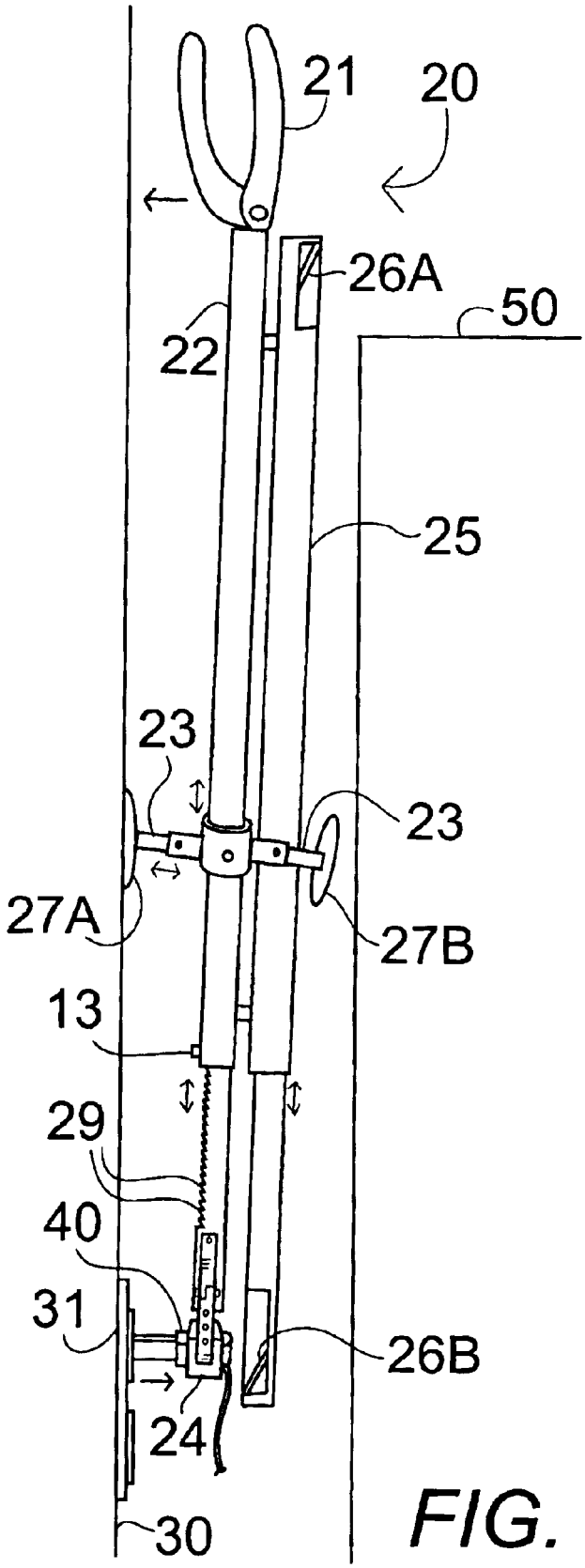
FIG. 2 is an elevational view of the electric plug remover and installer device of FIG. 1 removing an electric plug from the electric wall outlet behind the piece of furniture using the pivot arm of the device against the wall for leverage.

In FIGS. 1 and 2, an electric plug installer and remover device 20 for installing and removing an electric plug 40 in an electric wall outlet 31 located on a portion of a wall 30 behind an obstruction 50 comprises a rigid elongated lever arm 22 that has a bottom clamp 24 attached to the bottom end of the lever arm 22. The lever arm 22 is formed of two telescoping components and is adjustable in length by an adjustable means such as teeth 29 with a snap lock controlled by a button 13. The bottom clamp 24 comprises a pair of jaws that are pivotally attached together. The bottom clamp 24 grips and releases an electric plug 40 for installing and removing the electric plug 40 from the electric wall outlet 31 when the wall outlet 31 is positioned on a wall 30 behind an obstruction 50.

Figure 3:
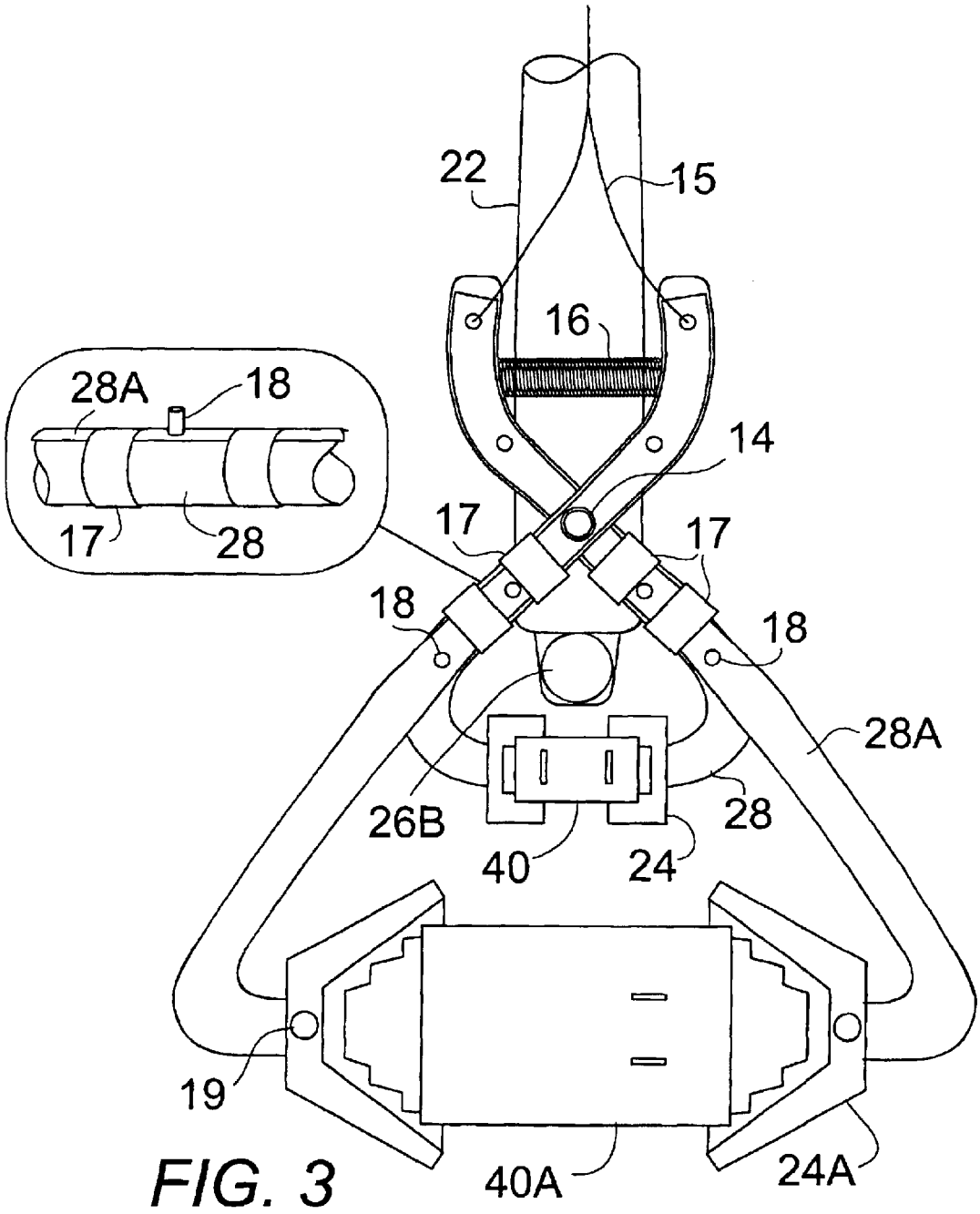
FIG. 3 is a partial side elevational view of the electric plug remover of FIG. 1 showing add-on elongated clamp arms with enlarged grips attached to the plug clamp to enable gripping larger plugs such as those housing transformers.

The device 20 further comprises a top hand grip 21 attached to the lever arm 22 at the top end of the lever arm 22. The hand grip 21 comprises a pair of handles that are pivotally connected. The hand grip 21 has a means for communicating with the bottom clamp 24, thereby opening and closing the bottom clamp 24. The means of communicating comprises a cable means 15, as shown in FIG. 3 between the top hand grip 21 and the bottom clamp 24 which cable causes the bottom clamp 24 to close upon closing the hand grip 21 and open by the force of a spring 16 upon release of the hand grip 21.

The device 20 also comprises a pair of pivot arms 23 that are movably attached to the lever arm 22 and are positioned between the top end and the bottom end of the lever arm 22. The pair of pivot arms 23 extend outwardly from the lever arm 22 on opposing sides of the lever arm 22. The pivot arms 23 are of two different lengths and each comprise two telescoping or screw-in or other components that are adjustable in length. Each of the pivot arms has a contact pad 27A and 27B of resilient material to pad the contact of the pivot arms 23 with the wall and obstruction and distribute the load.

In FIG. 2, one of the pair of pivot arms 23 with the contact pad 27A bears against the wall 30 to enable the removal of the electric plug 40 from the wall outlet 31 by moving the top end of the lever arm 22 toward the wall 30 (indicated by top arrow), thereby pivoting the bottom end of the lever arm 22 away from the wall 30 (indicated by the bottom arrow) with the electric plug 40 in the bottom clamp 24 and removing the electric plug 40 from the wall outlet 31.

In FIG. 1, the other of the pair of pivot arms 23 with the contact pad 27B bears against the obstruction 50 to enable the installation of the electric plug 40 in the wall outlet 31 by moving the top end of the lever arm 22 away from the wall 30 (as indicated by the top arrow), thereby pivoting the bottom end of the lever arm 22 toward the wall 30 (indicated by the bottom arrow) with the electric plug 40 in the bottom clamp 24, thereby installing the electric plug 40 in the wall outlet 31.

The device 20 may further comprise a periscope 25 that is attachable to the elongated lever arm 22 along the length of the lever arm 22, as shown in FIGS. 1–2. The periscope 25 comprises an elongated hollow telescoping tube that has a pair of angled mirrors 26A and 26B, which communicate between the top viewing opening 27A and the bottom opening 27B so that a user may look into the top opening 27A and see a wall outlet 31 adjacent to the bottom opening 27B of the periscope 25. The telescoping periscope tube 25 changes length by telescoping with the telescoping of the lever arm 22.

In FIG. 3, add-on elongated clamp arms 28A, with pivotally attached (by pivots 19) enlarged grips 24A, are attached to the plug clamp arms 28 by sliding the elongated clamp arms 28A under sleeves 17 on the pivot arms 28 with pins 18 on the pivots arms 28 engaging holes on the elongated clamp arms 28A, to enable gripping larger plugs 40A such as those housing transformers. The pivot arms 28 pivot on a pivot pin 14 which is attached to the lever arm 22 and the wire connections 15 extend from the upper ends of the pivot arms through the hollow lever arm to the hand grip above which squeezes the clamps 24 or 24A closed on the plugs 40 or 40A by pulling up the wire 15. The spring 16 between the tops of the scissor-like lever arms normally biases the clamps 24 and 24A open and causes the clamps to open upon release of the hand grip, thereby releasing the plug.

In practice, a user would first adjust the length of the remote electrical plug inserter and remover 20 by telescopically sliding the two portions of the long adjustable lever arm 22 until the desired length is achieved. Next, the user would adjust the length of the adjustable pivot arms 23 by telescopically sliding the two portions of each of the adjustable pivot arms 23 until the desired length is achieved, so that the device 20 would fit between the wall 30 and the piece of furniture 50 with the length of the pivot arm adjusted to develop the required leverage.

The user would insert an electrical plug 40 into a wall plug receptacle 31 by first operating the squeeze handle 21 to cause the clamp 24 to hold the plug 40. Next, the clamp 24 end of device 20 would be placed between the wall 30 and the obstruction 50, such as a piece of furniture, with one of the pivot arms 23 with the contact pad 27B on the obstruction 50, as shown in FIG. 1. The user would then look through the top mirror 26A in the top opening 27A of the periscope 25 to remotely view and align the plug 40 with the wall plug receptacle 31. Next, the user would pull the handle 21 end of the lever arm 22 towards the obstruction 50 (as indicated by the top arrow), thereby causing a lever-type action that will insert the plug 40 into the wall plug receptacle 31 (as indicated by the bottom arrow). By releasing the hand grip 21 the user can cause the clamp 24 to release the plug 40 and then extricate the device 20 from between the wall 30 and the obstruction 50.

To remove an electrical plug 40 from a wall plug receptacle 31 the clamp 24 end of device 20 would be placed between the wall 30 and the obstruction 50, with one of the pivot arms 23 with the contact pad 27B on the wall 30, as shown in FIG. 2. The user would then look through the top mirror 26A in the top opening 27A of the periscope 25 to remotely view and align the clamp 24 with the plug 40. By squeezing the hand grip 21 the user can then cause the clamp 24 to grasp the plug 40. The user would then push the hand grip 21 end of the lever arm 22 towards the wall 30 (as indicated by the top arrow), thereby causing a lever-type action that will remove the plug 40 from the receptacle 31 (as indicated by the bottom arrow). The hand grip 21 may be released to release the plug and the device 20 may then be removed from between the wall 30 and the obstruction 50.

It is understood that the preceding description is given merely by way of illustration and not in limitation of the invention and that various modifications may be made thereto without departing from the spirit of the invention as claimed.

What is claimed is:

1. An electric plug installer and remover device for installing and removing an electric plug in an electric wall outlet located on a portion of a wall behind an obstruction, the device comprising:

a rigid elongated lever arm having a bottom clamp attached to a bottom end of the lever arm, the bottom clamp capable of gripping and releasing an electric plug for installing the electric plug in an electric wall outlet and removing the electric plug for the electric wall outlet with the wall outlet positioned on a wall behind an obstruction, and a top hand grip attached to the lever arm at a top end of the lever arm, the hand grip having a means for communicating with the bottom clamp and the hand grip capable of opening and closing the bottom clamp;

a pair of pivot arms movably attached to the lever arm and capable of being positioned between the top end and the bottom end of the lever arm, the pair of pivot arms extending outwardly from the lever arm on opposing sides of the lever arm, one of the pair of pivot arms capable of bearing against the wall to enable the removal of the electric plug from the wall outlet by moving the top end of the lever arm toward the wall, thereby pivoting the bottom end of the lever arm away from the wall with the electric plug in the bottom clamp removing the electric plug from the wall outlet, and the other of the pair of pivot arms capable of bearing against the obstruction to enable the installation of the electric plug in the wall outlet by moving the top end of the lever arm away from the wall, thereby pivoting the bottom end of the lever arm toward the wall with the electric plug in the bottom clamp, thereby installing the electric plug in the wall outlet.

2. The device of claim 1 wherein the clamp comprises a pair of jaws with lever arms pivotally attached together and the hand grip comprises a pair of handles pivotally connected and the means of communicating comprises a cable means between the top hand grip and the lever arms which cable causes the bottom clamp to close upon squeezing the hand grip and the clamp further comprises a spring normally biased open between a top of the lever arms and the spring is capable of causing the clamps to open upon releasing the hand grip.

3. The device of claim 1 wherein the lever arm is formed of at least two telescoping components and is adjustable in length.

4. The device of claim 1 wherein the pivot arms are of two different lengths.

5. The device of claim 1 wherein the pivot arms each comprise at least two telescoping components and are adjustable in length.

6. The device of claim 1 further comprising a periscope attachable to the elongated lever arm along the length of the lever arm, the periscope comprising an elongated hollow tube having at least one pair of angled mirrors communicating between a top viewing opening and a bottom opening so that a user may look into the top opening and see a wall outlet adjacent to the bottom opening.

7. The device of claim 1 further comprising a pair of add-on elongated clamp arms capable of being attached to the bottom clamp, the add-on elongated clamp arms each having an enlarged grip to enable gripping larger plugs including plugs housing transformers.

* * * * *